United States Patent [19]

Greding

[11] Patent Number: 4,469,286

[45] Date of Patent: Sep. 4, 1984

[54] FREE FLOATING RIDER ROLL BEAM MOUNTING

[75] Inventor: Robert Greding, Beaconsfield, Canada

[73] Assignee: Valmet-Dominion Inc., Lachine, Canada

[21] Appl. No.: 470,442

[22] Filed: Feb. 28, 1983

[51] Int. Cl.[3] ..... B65H 17/12; B65H 25/26

[52] U.S. Cl. ..... 242/65; 242/67.1 R; 242/68.7

[58] Field of Search ..... 242/67.1 R, 65, 66, 242/68, 68.1, 68.7

[56] References Cited

U.S. PATENT DOCUMENTS

| | | | |
|---|---|---|---|
| Re. 2,191 | 3/1866 | Forsyth | 242/66 |
| 3,206,134 | 9/1965 | Printz et al. | 242/66 |
| 3,642,222 | 2/1972 | Leysinger | 242/66 |

*Primary Examiner*—Billy S. Taylor
*Assistant Examiner*—Lloyd D. Doigan
*Attorney, Agent, or Firm*—Raymond A. Eckersley

[57] ABSTRACT

A rider roll beam is mounted in a pair of opposed frames having substantially vertical guide surfaces and the axial ends of the beam are provided with curved surfaces cooperating with the vertical guide surfaces to permit the beam to pivot about a horizontal axis located at about the midpoint of the machine and extending substantially perpendicular to the longitudinal axis of the beam. The rider roll beam is also provided with tongues that are received in glide slots having substantially vertical sidewalls so that the beam cannot pivot about its longitudinal axis or a substantially vertical axis. Preferaly the rider roll beam will be directly supported at each end by a hydraulic cylinder that raises and lowers each end of beam substantially independently of the other.

16 Claims, 3 Drawing Figures

FREE FLOATING RIDER ROLL BEAM MOUNTING

FIELD OF THE INVENTION

The present invention relates to a rider roll beam mounting for a winder for winding paper rolls. More particularly the present invention relates to a free floating mounting for a rider roll beam wherein the beam is permitted to rotate about a substantially horizontal axis positioned midpoint of the machine while the beam is moved substantially vertically.

BACKGROUND OF THE INVENTION

The rider rolls are provided on two drum winders to facilitate the winding of the roll and the building of an acceptable roll structure that can be further handled for shipping, printing etc.

A variety of different mounting structures have been provided for mounting rider rolls or rider roll beams on the winder. Such means permit limited relative movement between the opposite axial extremities of the beam. Normally the drive to one end of the rider roll beam assembly is coordinated with the drive to the opposite end so that the opposite ends of the rider roll move up and down with only limited relative movement therebetween, i.e. the plane of the rider roll is maintained substantially horizontal although there is provision to accommodate some slight movement. Attention is directed to Canadian Pat. No. 932,315, issued Aug. 21, 1972 G. W. Dorfel.

Limited relative movement of one end of the beam to the other is accommodated in mounting by mounting one end of the beam for pivotal movement about a substantially horizontal axis on an element, the movement of which is guided substantially vertical by means of the frame member at one axial end of the equipment and on which the element is moveably mounted.

It has also been proposed to utilize hydraulic cylinders to move each end of the rider roll or rider roll beam assembly as shown for example in Canadian Pat. No. 571,669, issued Mar.3, 1959, to C. D. Nitchie, which utilizes separate hydraulic cylinders positioned one at each side of the machine to adjust the length of the chain mounting for the rider roll beam. In this arrangement the position of each end of the rider roll is accurately adjusted by means of a toothed rack on each of the vertical frames.

It has also been proposed to directly couple the ends of the rider roll beam to hydraulic cylinders and to utilize these hydraulic cylinders to directly move, i.e. without the use of intermediate chains, each end of the rider roll assembly. However, the movement of the ends of the rider roll assembly relative to each other is controlled and only very limited pivotal movement is permitted.

It will be apparent that in any drive system various friction forces are encountered and the drives to each end of the rider roll beam are influenced by forces other than the forces necessary to move the beam under ideal conditions, i.e. extraneous drag forces, poor lubrication etc., so that depending on the condition of the equipment the actual pressures applied to each end of the roll assembly may vary significantly. When opposite ends of the roll assembly are permitted only limited relative movement this imbalance of the pressures is difficult to detect and may in some cases result in poorer operation of the equipment since the pressure applied to each end of the roll being wound will not be substantially the same.

The thickness or calibration of paper is not uniform and thus as a roll of paper is wound from a continuous running length the local differences in caliber tend to accummulate so that the wound roll is not normally cylindrical but may be conical or barrel shaped or the like. Pivoted movement of a rider roll beam is intended at least in part to accommodate these different shapes, particularly a conical shaped roll to permit the application of a more uniform pressure across the roll as it is being wound. Most winder structures have the ability to accommodate a minor amount of taper in the roll structure and attempt to maintain relatively uniform pressure along the length of the roll by the slight pivotal movement of the beam, however, as above indicated implanted forces may well detract significantly from this ability.

Various techniques have been devised to try and balance these pressures including sensing of the pressure between the rider roll assembly and the roll being wound at each end of the assembly, and then adjusting the pressure applied to the ends of the roll assembly accordingly (within the limits of the equipment).

BRIEF DESCRIPTION OF THE PRESENT INVENTION

It is an object of the present invention to provide a simplified winder structure permitting relative movement between opposite ends of the rider roll beam to facilitate more uniform pressure distribution.

Broadly the present invention relates to a rider roll beam assembly mounting for a winder comprising a pair of end frames having a pair of substantially vertical faces, a rider roll beam between said frames, an arcuate surface at each axial end of said beam in face-to-face relationship with its adjacent of said vertical faces so as to cooperate with said vertical faces and permit rotation of said beam about a substantially horizontal axis extending substantially perpendicular to the longitudinal axis of the beam and located at about the midplane of said winder while limiting axial movement of the beam along its longitudinal axis, means for moving each end of said beam while permitting said rotation of said beams and means for guiding movement of each said end of said beam so that movement of said beam is in a substantially vertical plane substantially parallel to said longitudinal axis of said beam.

Preferably the means for moving each end of the beam will comprise hydraulic cylinders, one connected directly to each end of the beam.

BRIEF DESCRIPTION OF THE DRAWINGS

Further features, objects and advantages will be evident from the following detailed description of the preferred embodiment of the present invention taken in conjunction with the accompanying drawings in which:

As shown in FIG. 1 the winder 10 forming the present invention is provided with a pair of bottom drums 12 on which a roll of paper 13 is formed by rolling around a core in the conventional manner (in some cases the core may be omitted). On each side of the winder 10 is a frame 14, each of which in the illustrated arrangement is provided with a substantially vertical inner face 16. Each face 16 is divided into two separate surfaces 16 via a guide passage 18 having a pair of opposed substantially vertical guide faces 20 and 22 extending substantially perpendicular to the guide faces 16 (see FIGS. 2 and 3).

Figure 1:
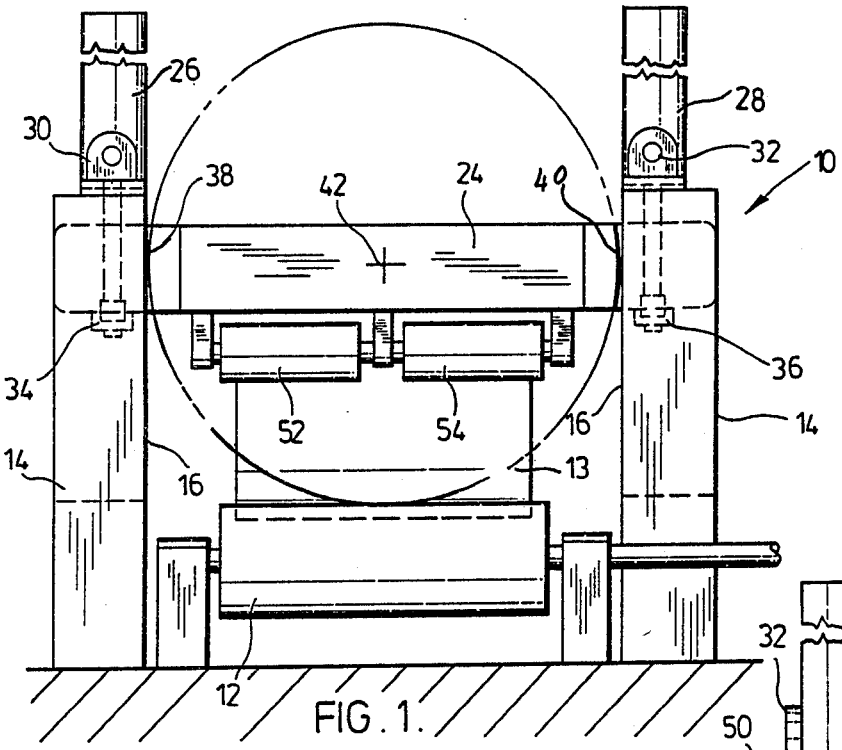
FIG. 1 is a schematic front view of a winder incorporating the present invention.

A rider roll beam 24 is mounted in the frame members 14 with each end thereof supported by a hydraulic piston and cylinder arrangement generally indicated at 26 and 28 respectively which are mounted on the top of the frames 14 via trunnions 30 and 32 and are connected to the rider roll assembly (beam) via pivot pins or the like 34 and 36 respectively. It will be apparent that with this mounting the pins 34 and 36 are not restrained to move vertically in a fixed path, but may be shifted in a horizontal direction as the opposite longitudinal ends of the beam move relatively vertically, i.e., as the beam is pivoted about a substantially horizontal axis, as will be described in more detail hereinbelow.

The rider roll beam is provided at each end with a curved surface indicated at 38 and 40, the curvature of which has a radius substantially equal to ½ the width of the winder (½ the spacing between the surfaces 16 on the spaced frames 14), i.e. from the axis generally indicated at 42 extending perpendicular to the longitudinal axis of the beam and located at the midplane of the winder.

In the illustrated arrangement the axis 42 is on or intersects the longitudinal central axis of the beam 24 so that the curved surfaces, which in the illustrated arrangement have a length equal to the height of the beam, will provide guidances for rotation of the beam 24 in either clockwise or counterclockwise direction around axis 42 an equal amount. If desired the ends of the beam may be extended preferably downwardly toward the rider rolls and the axis 42 shifted downwardly as well, it being preferred to align the axis 42 with a horizontal line intersecting the centers of the two curved surfaces 38 and 40 to provide for equal rotation in either direction.

Figure 3:
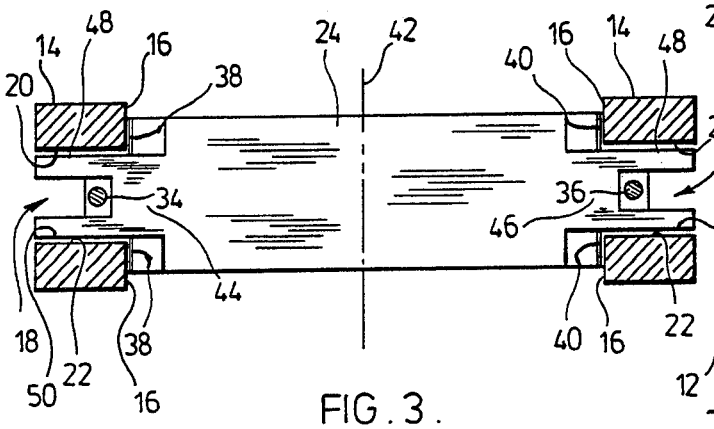
FIG. 3 is a partial plan view of the winder shown in FIG. 1.
Figure 2:
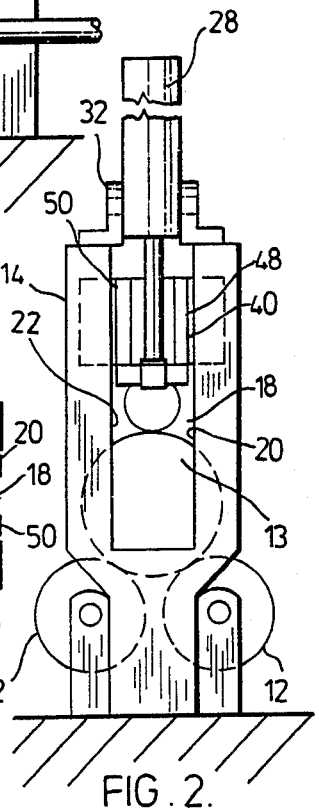
FIG. 2 is a side view of the winder.

These curved surfaces 38 and 40 are separated into two distinct sections, each adapted to cooperate with the separate guide sections 16—16 on each of the frame members 14 (see FIG. 3), by axially extending tongue members 44 and 46 projecting from opposite ends of the beam 24. These tongues 44 and 46 are provided on their opposite side faces with substantially vertical guide surfaces 48 and 50 adapted to cooperate with the surfaces 20 and 22 forming the sides of passages 18 on the frames 14 to permit the rider roll beam to move only in a substantially vertical plane.

In the illustrated arrangement a pair of rider rolls 52 and 54 are mounted on the rider roll beam via a suitable bearing arrangement so that the rolls 52 and 54 may rotate in contact with the paper roll 13.

In operation the rollers 52 and 54 mounted on the rider roll beam 24 are generally maintained in contact with the paper roll 13 by the weight of the rolls and the beam. The load is adjusted to that desired in the conventional manner via pressure applied through the cylinders 26 and 28. In the event the roll 13 is tapered, the rider roll beam 24 may pivot on its axis 42 to align the peripheral surfaces of the roll 52 and 54 with the taper on the roll 13.

This movement of the beam is guided via the surfaces 38 and 40 which cooperate with the surfaces 16 on the frames 14 and simply permit rotation about the axis 42 while the beam 24 is maintained in its vertical position via cooperation between the guide surfaces 20 and 22 on the frames 14 with the surfaces 48 and 50 respectively on the tongues 44 and 46.

When the rider roll beam is moved to a retracted position via the lifting action of the hydraulic cylinders 26 and 28 and assuming the drive or movement on one side of the beam is resisted more strongly than the movement on the opposite side there will be considerable rotation of the rider roll beam 24 about the axis 42 which will be immediately apparent to the operator, who will immediately recognize that non uniform pressure will probably be applied by the rider rolls when they are advanced into operative position against the next roll. The operator may then attempt to compensate for this or will alert maintenance and have the obvious defect corrected.

With a conventional mounting retraction of the rider roll beam will only permit very limited rotational movement of the rider roll beam generally around a pivotal axis located at one axial end of the rider roll beam. This limited movement is very difficult to detect thereby making it much more difficult for an operator to detect a maintenance problem and limiting the effectiveness of the equipment.

The surfaces 20 and 22 could be at the outsides of the frames 14 and the ends of the beam forked to surround the frames and provide guide surfaces in face-to-face relationship with those guide surfaces on the outsides of the frames 14 and the structure revised accordingly.

Having described the invention, modifications will be evident to those skilled in the art without departing from the spirit of the invention as defined in the appended claims.

What I claim as new and desire to secure by Letters Patent of the United States of America is:

1. A rider roll beam mounting for a winder comprising:

a pair of frames each having a substantially vertical face;

a rider roll beam spanning the distance between said frames;

an arcuate guiding surface adjacent each axial end of said beam in face-to-face relationship with the adjacent one of said vertical faces;

said surfaces being curved so as to cooperate with said vertical faces and permit rotation of said beam about a horizontal axis substantially perpendicular to the longitudinal axis of said beam and located at the midplane of said winder while limiting axial movement of said beam along its longitudinal axis;

means for moving each end of said beam while permitting said rotation of said beam and means for guiding movement of said beam in a vertical path substantially parallel to said longitudinal axis.

2. A rider roll being mounted as defined in claim 1 wherein said vertical faces are located on the inner surface of said frames facing one another.

3. A rider roll beam mounting as defined in claim 2 wherein said horizontal axis intersects a horizontal line extending between the midpoints of said arcuate guiding surfaces.

4. A rider roll beam mounting as defined in claim 1 wherein said means for moving each end of said beam comprises a hydraulic piston and cylinder arrangement connected directly to the adjacent end of said beam.

5. A rider roll beam mounting as defined in claim 1 wherein said means for guiding said beam for movement in a vertical path comprises:

tongue means projecting from each axial end of said beam;

substantially vertical guide faces on said frames extending at an angle to said vertical faces and cooperating guide faces on said tongue means.

6. A rider roll beam mounting as defined in claim 2 wherein said means for guiding said beam for movement in a vertical path comprises:

tongue means projecting from each axial end of said beam;

substantially vertical guide faces on said frames extending at an angle to said vertical faces and cooperating guide faces on said tongue means.

7. A rider roll beam mounting as defined in claim 3 wherein said means for guiding said beam for movement in a vertical path comprises:

tongue means projecting from each axial end of said beam;

substantially vertical guide faces on said frames extending at an angle to said vertical faces and cooperating guide faces on said tongue means.

8. A rider roll beam as defined in claim 1 wherein said vertical face on each said frame is divided into a pair of spaced faces.

9. A rider roll beam as defined in claim 2 wherein said vertical face on each said frame is divided into a pair of spaced faces.

10. A rider roll beam as defined in claim 3 wherein said vertical face on each said frame is divided into a pair of spaced faces.

11. A rider roll beam mounting as defined in claim 1 wherein said means for guiding said beam for movement in a vertical path comprises:

a tongue projecting from each axial end of said beam each received within a respective passage in their respective adjacent frame;

substantially vertical guide faces forming the inner surfaces of said passage and cooperating guide faces on opposite sides of said tongues.

12. A rider roll beam mounting as defined in claim 2 wherein said means for guiding said beam for movement in a vertical path comprises:

a tongue projecting from each axial end of said beam each received within a respective passage in their respective adjacent frame;

substantially vertical guide faces forming the inner surfaces of said passage and cooperating guide faces on opposite sides of said tongues.

13. A rider roll beam mounting as defined in claim 3 wherein said means for guiding said beam for movement in a vertical path comprises:

a tongue projecting from each axial end of said beam each received within a respective passage in their respective adjacent frame;

substantially vertical guide faces forming the inner surfaces of said passage and cooperating guide faces on opposite sides of said tongues.

14. A rider roll beam mounting as defined in claim 1 wherein said means for guiding said beam for movement in a vertical path comprises:

a tongue projecting from each axial end of said beam each received within a respective passage in their respective adjacent frame members;

substantially vertical guide faces forming the inner surfaces of said passage and cooperating guide faces on opposite sides of said tongues; and wherein each said vertical face on each said frame is divided into two faces by the respective passage in each said frame.

15. A rider roll beam mounting as defined in claim 2 wherein said means for guiding said beam for movement in a vertical path comprises:

a tongue projecting from each axial end of said beam each received within a respective passage in their respective adjacent frame members;

substantially vertical guide faces forming the inner surfaces of said passage and cooperating guide faces on opposite sides of said tongues; and wherein each said vertical face on each said frame is divided into two faces by the respective passage in each said frame.

16. A rider roll beam mounting as defined in claim 3 wherein said means for guiding said beam for movement in a vertical path comprises:

a tongue projecting from each axial end of said beam each received within a respective passage in their respective adjacent frame members;

substantially vertical guide faces forming the inner surfaces of said passage and cooperating guide faces on opposite sides of said tongues; and wherein each said vertical face on each said frame is divided into two faces by the respective passage in each said frame.

* * * * *